US011801506B2

(12) United States Patent
Nielsen et al.

(10) Patent No.: US 11,801,506 B2
(45) Date of Patent: Oct. 31, 2023

(54) FLUID EJECTIONS IN NANOWELLS

(71) Applicant: HEWLETT-PACKARD DEVELOPMENT COMPANY, L.P., Spring, TX (US)

(72) Inventors: Jeffrey A. Nielsen, Corvallis, OR (US); Christie Dudenhoefer, Corvallis, OR (US); Kenneth Ward, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 437 days.

(21) Appl. No.: 16/767,086

(22) PCT Filed: Jan. 30, 2018

(86) PCT No.: PCT/US2018/015836

§ 371 (c)(1),
(2) Date: May 26, 2020

(87) PCT Pub. No.: WO2019/151972

PCT Pub. Date: Aug. 8, 2019

(65) Prior Publication Data

US 2020/0368737 A1 Nov. 26, 2020

(51) Int. Cl.
*B01L 3/02* (2006.01)

(52) U.S. Cl.
CPC ..... *B01L 3/0268* (2013.01); *B01L 2300/0829* (2013.01); *B01L 2300/0896* (2013.01); *B01L 2400/0439* (2013.01)

(58) Field of Classification Search
None
See application file for complete search history.

(56) References Cited

U.S. PATENT DOCUMENTS

| | | | | |
|---|---|---|---|---|
| 5,807,522 | A * | 9/1998 | Brown | G01N 33/54366 422/50 |
| 6,280,148 | B1 * | 8/2001 | Zengerle | B01L 3/0265 417/44.1 |
| 6,375,294 | B1 | 4/2002 | Kneezel | |
| 7,427,379 | B1 | 9/2008 | Hagerlid | |
| 7,736,591 | B2 | 6/2010 | Rose | |
| 8,808,644 | B2 | 8/2014 | Panetz | |
| 9,278,321 | B2 | 3/2016 | Dale | |

(Continued)

FOREIGN PATENT DOCUMENTS

| | | |
|---|---|---|
| WO | WO-2008131383 A1 | 10/2008 |
| WO | WO-2016134342 A1 | 8/2016 |
| WO | WO-2017205687 A1 | 11/2017 |

OTHER PUBLICATIONS

Product catalogue by the microfluidic ChipShop GmbH, microfluidic product catalogue, 30 pages, Feb (Year: 2008).*

(Continued)

*Primary Examiner* — J. Christopher Ball
(74) *Attorney, Agent, or Firm* — Foley & Lardner LLP

(57) ABSTRACT

A fluid ejection system, in an example, includes at least one nozzle of at least one die from which a fluid is ejected and at least one nanowell at which the at least one nozzle ejects an amount of fluid. A method of dispensing a fluid, in an example, includes addressing at least one nanowell with at least one nozzle of at least one die, and depositing a fluid in the nanowell with the at least one nozzle.

19 Claims, 4 Drawing Sheets

(56) References Cited

U.S. PATENT DOCUMENTS

| | | | | |
|---|---|---|---|---|
| 9,427,734 | B2 | 8/2016 | Nielsen | |
| 2003/0059949 | A1 * | 3/2003 | Gilbert | C12Q 1/00 422/504 |
| 2016/0231345 | A1 | 8/2016 | Merzenich | |

OTHER PUBLICATIONS

AMT™, Automated Machine Technologies, Inc., 2005,.
(Cont. from above) http://amtliquidfilling.com/microliter.html.

* cited by examiner

FLUID EJECTIONS IN NANOWELLS

BACKGROUND

Printing devices are used to eject a fluid onto a surface. The ejection of the fluid onto the surface at specific locations creates an image. The precision of the ejection of the fluid can increase the quality of the resulting image.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
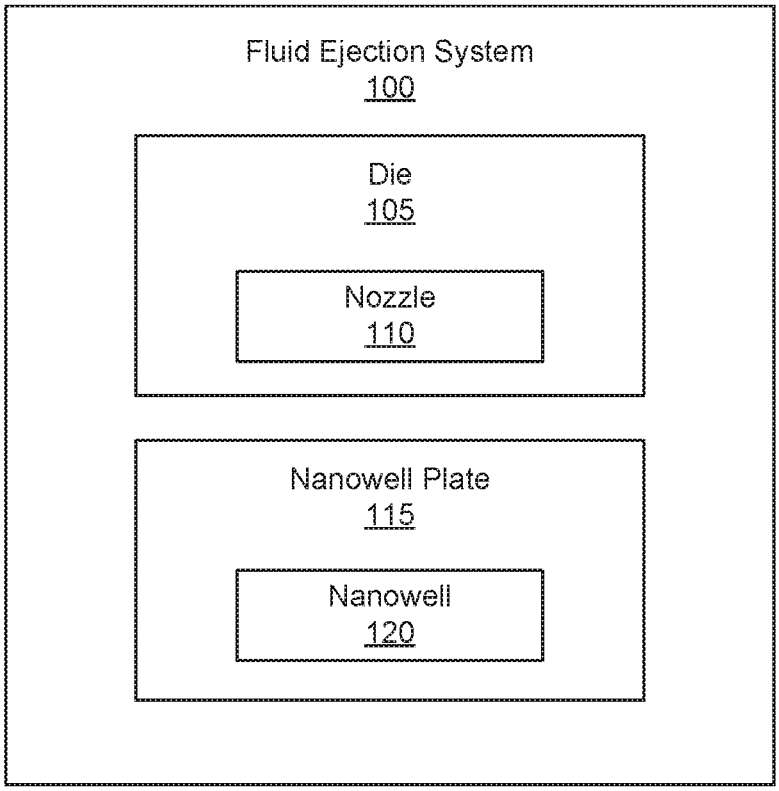
FIG. 1 is a block diagram of a fluid ejection system according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

A printing device may eject a fluid onto a surface in order to precisely deposit an amount of fluid onto a deposition surface. In some examples, the printing device may be used to dispense precision quantities of fluids into wells on a well-plate. During use, however, a plurality of nozzles is fired simultaneously in order to dispense these fluids into macro-size wells that could otherwise be filled to any degree using, for example, a pipetting technique. The micro-wells may have inlet area cross-sections that are many times greater than the size of the orifice of the nozzle formed in a die of a fluid ejection device used by the printing device. In some examples, the micro-wells may have an inlet area greater than 11,000 times the size of the orifice. Consequently, several nozzles may be used to fire into each of these micro-sized wells.

Ejecting fluid into these micro-wells with the significantly smaller orifices of the nozzles, however, may be time consuming, as well as use an increased amount of fluid to fill or add fluid into the micro-well. Nanowells include those wells that have in inlet cross-sectional area that is, at most, 625 times the size of the orifice of the nozzles. Because of the dispensing precision of the printing device, these individual nanowells may be address by a single nozzle in the die. Additionally, the size of the nanowells reduces the amount of fluid used to fill the nanowell as compared to a micro-well, as well as reduce the time to fill the nanowell.

The present specification describes, in an example, a fluid ejection system that includes at least one nozzle of at least one die from which a fluid is ejected and at least one nanowell at which the at least one nozzle ejects an amount of fluid.

The present specification further describes, in an example, a method of dispensing a fluid including addressing at least one nanowell with at least one nozzle of at least one die filling the nanowell with the at least one nozzle.

The present specification further describes a dispensing system, including a processor, a fluid ejection device comprising at least one die, the at least one die comprising at least one nozzle, and a nanowell plate comprising at least one nanowell wherein the at least one nozzle fills the at least one nanowell with a fluid.

As used in the present specification and in the appended claims, the term "nanowell" is meant to be understood as a target area on a substrate that may maintain nanoliter amounts of fluid or less. In an example, the nanowell is a concave structure formed on a plate into which a nanoliter amount of fluid may be dispensed. In another example, the nanowell is a two-dimensional surface such as paper or glass that does not have a concave structure but instead is a targeted area on the two-dimensional surface. Because of certain surface tensions between certain fluids and surfaces, the nanowell in this example may be defined on the two-dimensional surface. In an example, the nanowell may have an opening having a circular diameter of less than or equal to 1.1 mm.

As used in the present specification and in the appended claims, the term "fill" is meant to be understood as the deposition of any amount of any material into or onto any surface. In an example, the term "fill" may be used to describe the ejection of any amount of fluid into or onto a nanowell.

As used in the present specification and in the appended claims, the term "rasterize" or "rasterization" is meant to be understood as the process of executing computer readable instructions to direct a nozzle of a fluid ejection system to eject an amount of fluid therefrom at a specified addressable location.

Turning now to the figures, FIG. 1 is a block diagram of a fluid ejection system (100) according to an example of the principles described herein. The fluid ejection system (100) may include at least one die (105) into which at least one nozzle (110) is formed. The die (105) may be made of silicon and may include any number of thin film layers. In an example, the nozzle (110) may include a fluidic chamber housing a fluid actuator. During operation, the fluid actuator may cause an amount of fluid to be ejected from the firing chamber and out of an orifice. In an example, the fluid actuator is a thermoresistive device that, when a voltage is applied to the thermoresistive device, causes a drive bubble to form within the firing chamber that pushes out droplets of printing fluid through the orifice. In an example, the fluid actuator is a piezoelectric device that, as a voltage is applied to the piezoelectric device, causes the piezoelectric device to contract or expand thereby ejecting an amount of printing fluid out of the orifice.

The fluid ejection system (100) may further include a nanowell plate (115) having at least one nanowell (120). In an example, the nanowell plate may be made of glass, plastic, paper, or another material and may be formed into a two-dimensional plane. In this example, the nanowell (120) may be formed as a target location along the surface of the two-dimensional plane. In this example, the target location may be defined by a chemical barrier formed around the target location. In an example, the nanowell (120) is a concave well formed into the surface of the nanowell plate (115) that may hold an amount of fluid ejected from the nozzle (110) of the die (105). In this example, the volume of the nanowell (120) may be on the scale of nanoliters. In an example, the nanowell (120) may have a 400 picoliter volumetric capacity. In an example, the nanowell (120) may have a 50 nanoliter volumetric capacity. In an example, the nanowell (120) may have a volumetric capacity less than 1000 nanoliters.

As described herein, the nanoliter volume of the nanowell (120) may decrease the amount of fluid ejected into the nanowell (120) thereby saving costs in ejected fluid. In some examples, the fluid ejected may be relatively expensive and limiting the use and/or quantities of these fluids would reduce the costs in operating the fluid ejection system (100). Additionally, the nozzle (110), in addition to being relatively more precise than, for example, a pipette, ejects amounts of fluid on the scale of picoliters. With such relatively small amounts of fluid ejected into the nanowell (120), it will take longer to fill a micro-well than to fill the nanowell (120) described herein, thus reducing the time in operation of the fluid ejection system (100).

The nanowell plate (115) may include any number of nanowells (120). In an example, a plurality of nanowells (120) may be grouped together into groups such as an array of nanowells (120). In an example, each of the arrays of nanowells (120) may be representative of certain reactions or analysis to be conducted. The die (105) may be provided with any number of fluids to be ejected into any one or multiples of the nanowells (120). In an example, a plurality of nozzles (110) of the die (105) may be used simultaneously to eject any number of fluids into any number of nanowells (120).

During operation, the fluid ejection system (100) may receive computer-usable or computer-readable program code or instructions to be executed on a processor associated with the fluid ejection system (100). Execution of the computer-usable program code may cause the die (105) or nanowell plate (115) to be rasterized relative to each other such that any of the distinct fluids ejected from any of the nozzles (110) of the die (105) may be ejected into any of the nanowells (120). By doing so, any type of fluid may be ejected either simultaneously or asynchronously into any of the nanowells (120).

Figure 2:
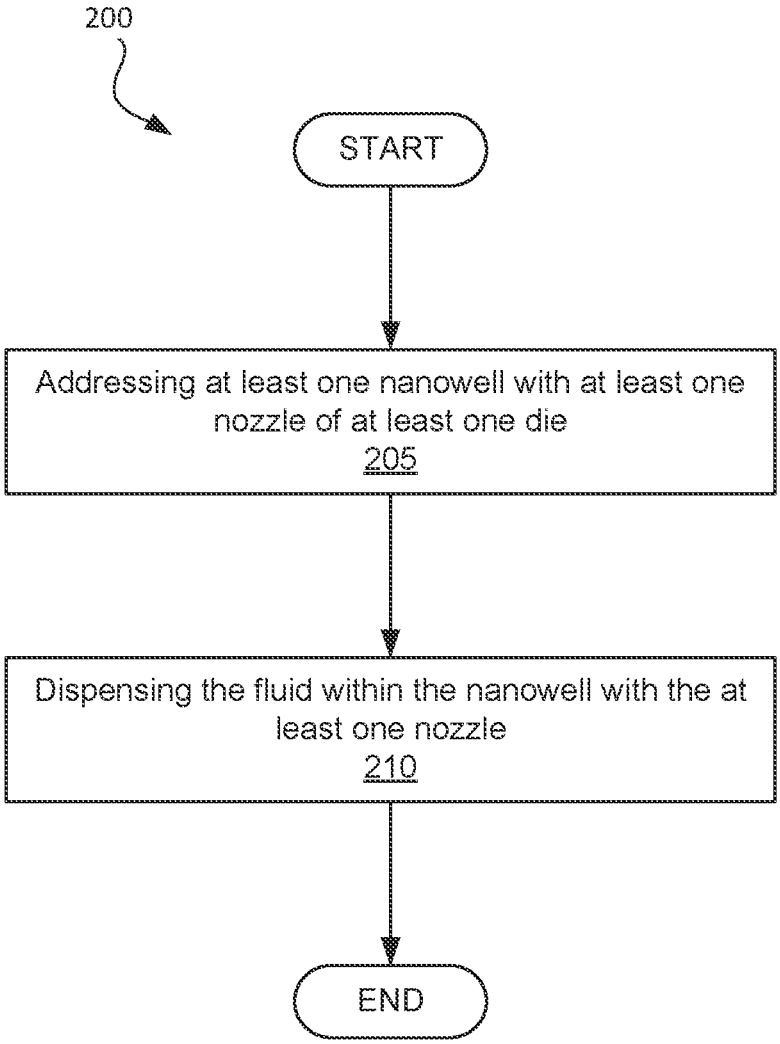
FIG. 2 is a flowchart depicting a method of dispensing fluid according to an example of the principles described herein.

FIG. 2 is a flowchart depicting a method (200) of dispensing fluid according to an example of the principles described herein. The method (200) may begin with addressing (205) at least one nanowell (120) with at least one nozzle (110) of at least one die (105). Addressing (205) the nanowell (120) with the nozzle (110) may include rasterizing either the nanowell plate (115) and/or the die (105) in order to place the nozzle (110) above the nanowell (120) to have fluid ejected into or onto the nanowell (120).

The method (200) may continue with dispensing (210) the fluid within the nanowell with the at least one nozzle (110). The amount of fluid ejected into or onto any of the nanowells (120) may be varied based on a procedure or purpose of the fluid being ejected. In some examples, the fluid ejected may be one or a combination of solvent-based pharmaceutical compounds, aqueous-based pharmaceutical compounds, aqueous-based biomolecules comprising proteins, enzymes, lipids, antibiotics, mastermix, primer, DNA samples, cells, blood components, surfactants, or glycerol. Any of these types of fluids may be ejected from any of the plurality of nozzles (110) of the die (105) in order to complete a chemical reaction, analyze and analyte, or complete any type of diagnosis.

As described herein, a plurality of nozzles (110) formed in any number of die (105) may be used to simultaneously address (205) a plurality of nanowells. In this example, each or some of the plurality of nozzles may eject a distinct type of fluid or may eject the same type of fluid. In an example, nozzles used to eject one type of fluid may be used to fill or eject fluid onto a nanowell (120) and be rasterized to do the same in a previously addressed nanowell (120). In an example, the fluid ejection system (100) described herein may have a plurality of die (105) each having a plurality of nozzles (110). In this example, at least two of the plurality of nanowells (120) may be filled using nozzles (110) from at least two distinct die (105).

Figure 3:
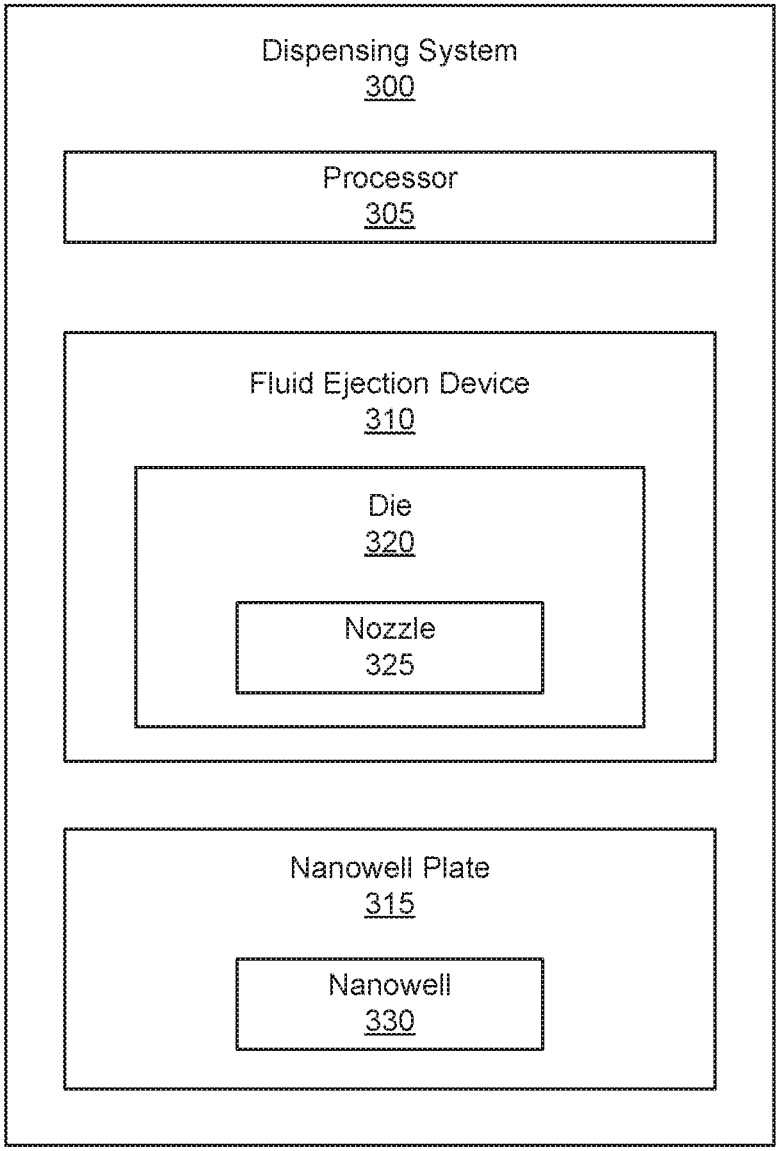
FIG. 3 is a block diagram of a dispensing system according to an example of the principles described herein.

FIG. 3 is a block diagram of a dispensing system (300) according to an example of the principles described herein. The dispensing system (300) may include a processor (305), a fluid ejection device (310), and a nanowell plate (315). The fluid ejection device (310) may include at least one die (320) with the at least one die (320) comprising at least one nozzle (325). The nanowell plate (315) may include at least one nanowell (330) defined thereon or therein.

During operation, the processor (305) may execute computer-usable program code to move the at least one nozzle (325) of the at least one die (320) over a plurality of nanowells (330) to deposit an amount of fluid therein or thereon. The execution of the computer-usable program code may cause signals to be sent to a number of devices, such as motors, which may be used to move the fluid ejection device (310), the nanowell plate (315), or both such that at least one of the nozzles (325) of one of the die (320) may be aligned with a nanowell (330) on or in the nanowell plate (315) to eject an amount of fluid into the nanowell (330).

As described herein, the nanowell plate (315) may have any number of nanowells (330) defined therein or thereon. In an example, multiple nozzles (325) may eject fluid into or onto multiple nanowells (330) simultaneously or asynchronously, Each of the nozzles (325) may eject a distinct type of fluid into any one of the nanowells (330) during operation.

Figure 4:
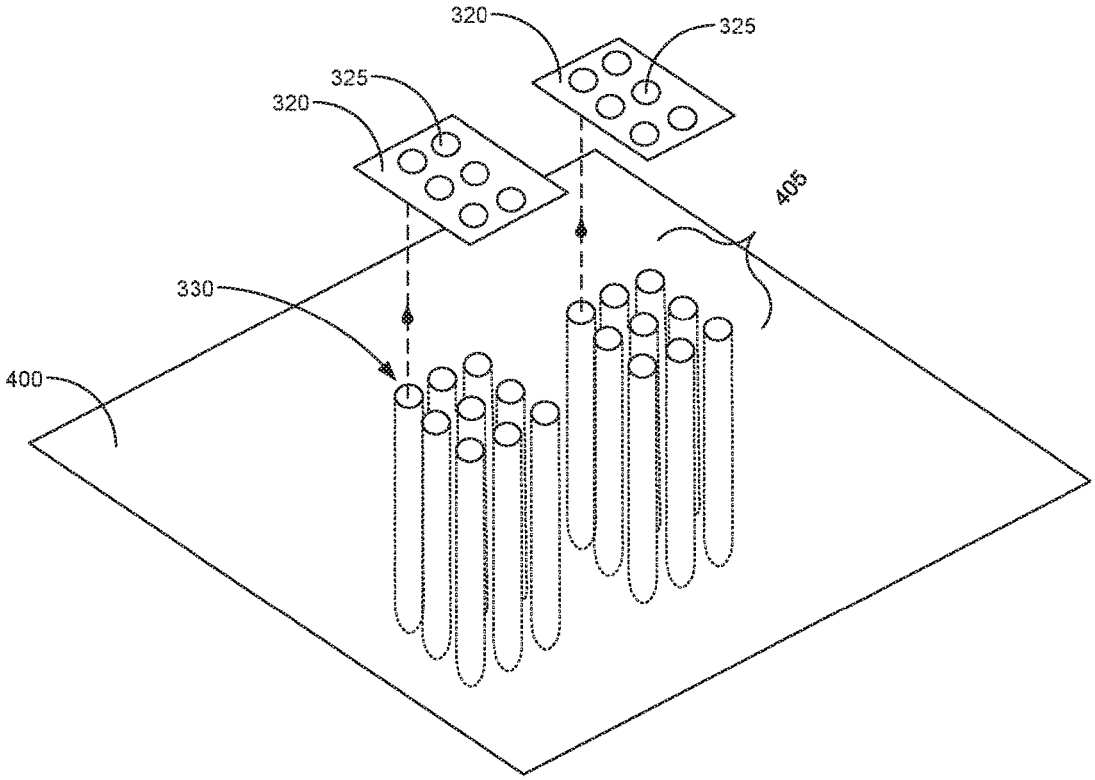
FIG. 4 is a perspective view of a nanowell plate according to an example of the principles described herein.

FIG. 4 is a perspective view of a nanowell plate (400) according to an example of the principles described herein. FIG. 4 shows a plurality of nanowells (330) defined in the nanowell plate (400). A plurality of die (320) may each have a plurality of nozzles (325) which may eject an amount of fluid into the plurality of nanowells (330) either simultaneously or asynchronously as described herein.

The plurality of nanowells (330) may be grouped into an array (405). Each array (405) may include any number of nanowells (330). In an example, each array (405) may define an individual location where an analyte and/or reaction is to be placed and/or conducted. In this example shown in FIG. 4, the two die (320) may be moved together allowing multiple arrays (405) to be filled using the nozzles (325) of each of the dies.

Although FIG. 4 shows a specific number of nanowells (330) grouped into a specific number of arrays (405) this is meant merely as an example. In an example, the nanowells (330) may not be partitioned into any number of arrays (405). The present specification contemplates the use of any number of nanowells (330) arranged in any manner.

During operation of the fluid ejection device (310) described herein with the nanowell plate (400) and the number of die (320), the number of ejections of fluid from the nozzles (325) may determine how much fluid each of the nanowells (330) contains at any given point in time. This may be accomplished by determining the amount of fluid that is ejected from a nozzle (325) and multiplying that volume (in picoliters) by the number of ejections of fluid into any given nanowell (330).

Additionally, although FIG. 4 shows a specific shape of the nanowell (330) or specific shape of the opening of the nanowell (330), other shapes may be used and the present specification contemplates the use of these shapes. In an example, the opening of the nanowell (330) may be 300 microns in diameter. In other examples, the diameter of the opening of the nanowell (330) may be equal or less than 625 times the diameter of the orifice of the nozzle (325). In an example, the nanowells (330) may be spaced apart by 500 microns. However, these dimensions are merely meant to be examples and the present specification contemplates other dimensions.

The use of fluid ejection devices (310) with the die (320) allows for a device that can fill the nanowells (330) without spilling the fluid into neighboring wells defined in or on the nanowell plate (315). This prevents certain contamination or cross-contamination within any given nanowell (330) between fluids and/or other diagnostic or analytic materials described herein. This is because the size of the orifice of the nozzle (325) may precisely eject the fluid into the relatively small target area of the nanowell (330). Further, because the die (320) does not contact the nanowell plate (315), this prevents any cross-contamination and/or contamination between the nanowells (330) as well.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection system comprising:

a plurality of nozzles formed on a die to eject a fluid, each nozzle comprising a firing chamber housing a fluid actuator to, when actuated, cause an amount of fluid to be ejected from the firing chamber through an orifice, the die comprising one or more thin film layers; and at least one nanowell formed on a nanowell plate at which at least one of the plurality of nozzles ejects an amount of fluid, the at least one nanowell comprising a chemical barrier formed around a target location on the nanowell plate.

2. The fluid ejection system of claim 1, wherein the at least one nanowell is formed into the nanowell plate comprising a plurality of nanowells formed therein.

3. The fluid ejection system of claim 1, wherein the at least one of the plurality of nozzles is moved over a plurality of nanowells to deposit an amount of fluid therein.

4. The fluid ejection system of claim 1, wherein each of the plurality of nozzles ejects fluid into at least one nanowell of a plurality of nanowells.

5. The fluid ejection system of claim 1, further comprising a plurality of nanowells wherein one or more of the plurality of nanowells are grouped into distinct arrays of nanowells.

6. The fluid ejection system of claim 1, wherein the fluid comprises one of solvent-based pharmaceutical compounds, aqueous-based pharmaceutical compounds, aqueous- based biomolecules comprising proteins, enzymes, lipids, antibiotics, mastermix, primer, DNA samples, cells, blood components, surfactants, and glycerol, or combinations thereof.

7. A method of dispensing a fluid, comprising:

addressing at least one nanowell with one of a plurality of nozzles formed on a die, the die comprising one or more thin film layers; and dispensing the fluid within the at least one nanowell with the one of the plurality of nozzle, wherein the at least one nanowell comprises a chemical barrier formed around a target location.

8. The method of claim 7, wherein each of the plurality of nozzles addresses at least one of a plurality of nanowells and dispenses the fluid into the at least one of the plurality of nanowells simultaneously.

9. The method of claim 8, wherein at least two of the plurality of nanowells receive an amount of fluid using nozzles from at least two distinct dies.

10. A dispensing system, comprising:

a processor;

a fluid ejection device comprising at least one die, the at least one die comprising a plurality of nozzles formed thereon, each nozzle comprising a firing chamber housing a fluid actuator to, when actuated, cause an amount of fluid to be ejected from the firing chamber through an orifice, the die comprising one or more thin film layers; and a nanowell plate comprising at least one nanowell, the at least one nanowell comprising a chemical barrier formed around a target location on the nanowell plate;

wherein at least one of the plurality of nozzles is to dispense a fluid into the at least one nanowell.

11. The dispensing system of claim 10, wherein the processor executes computer-usable program code to move the at least one of the plurality of nozzles over a plurality of nanowells to deposit an amount of fluid therein.

12. The dispensing system of claim 10, wherein the nanowell plate further comprises a plurality of nanowells wherein one or more of the plurality of nanowells are grouped into distinct arrays of nanowells.

13. The dispensing system of claim 10, wherein the fluid ejection device further comprises a plurality of dies, each die comprising a nozzle to eject a distinct fluid into the at least one nanowell.

14. The dispensing system of claim 13, wherein the nanowell plate further comprises a plurality of nanowells, and wherein the nozzle of each die of the plurality of dies is to eject at least one distinct fluid into a distinct nanowell simultaneously.

15. The dispensing system of claim 10, wherein the fluid comprises one of solvent-based pharmaceutical compounds, aqueous-based pharmaceutical compounds, including aqueous-based biomolecules such as proteins, solvent-based pharmaceuticals, aqueous-based pharmaceutical compounds, aqueous-based biomolecules comprising proteins, enzymes, lipids, antibiotics, mastermix, primer, DNA samples, cells, blood components, surfactants, and glycerol, or combinations thereof.

16. The fluid ejection system of claim 1, wherein a spacing of the plurality of nozzles matches a spacing of a plurality of nanowells on the nanowell plate such that, when the die is positioned over the nanowell plate, the plurality of nozzles will be aligned over a respective plurality of nanowells on the nanowell plate.

17. The fluid ejection system of claim 1, wherein the at least one nanowell of the nanowell plate comprise an inlet cross-section that is, at most, 625 times the size of the orifice.

18. The fluid ejection system of claim 1, wherein different nozzles eject different and distinct types of fluid.

19. The dispensing system of claim 10, wherein a spacing of the plurality of nozzles matches a spacing of a plurality of nanowells on the nanowell plate such that, when the die is positioned over the nanowell plate, the plurality of nozzles will be aligned over a respective plurality of nanowells on the nanowell plate to dispense fluid into the respective plurality of nanowells.

* * * * *